US006490950B2

(12) United States Patent
Ray et al.

(10) Patent No.: US 6,490,950 B2
(45) Date of Patent: Dec. 10, 2002

(54) PROCESS OF MAKING A SET OF DISTINGUISHABLE ROBERTSON DRIVER BITS

(75) Inventors: James C. Ray, Lynchburg, VA (US); Tom Rankin, Hamilton (CA)

(73) Assignees: Ray-Griffin, Inc., Lynchburg, VA (US); Robertson, Inc., Milton (CA)

( * ) Notice: Subject to any disclaimer, the term of this patent is extended or adjusted under 35 U.S.C. 154(b) by 0 days.

(21) Appl. No.: 09/783,030

(22) Filed: Feb. 15, 2001

(65) Prior Publication Data

US 2001/0010833 A1 Aug. 2, 2001

Related U.S. Application Data

(62) Division of application No. 09/393,626, filed on Sep. 10, 1999, now abandoned.

(51) Int. Cl.[7] ..... B21K 5/00

(52) U.S. Cl. ..... 76/119; 81/436; 76/101.1

(58) Field of Search ..... 76/101.1, 119, 76/108.1; 81/121.1, 124.4, 124.6, 124.7, 436, 438, 439, DIG. 5, DIG. 11

(56) References Cited

U.S. PATENT DOCUMENTS

| | | | | | |
|---|---|---|---|---|---|
| 2,667,194 | A | * | 1/1954 | Fischer et al. | 81/438 |
| 3,903,761 | A | * | 9/1975 | Runton | 76/119 |
| 4,559,936 | A | | 12/1985 | Hill | |
| 4,581,962 | A | | 4/1986 | Marbourg | |
| 4,825,732 | A | | 5/1989 | Arnold | |
| 4,947,713 | A | | 8/1990 | Arnold | |
| 4,982,627 | A | | 1/1991 | Johnson | |
| 5,031,488 | A | | 7/1991 | Zumeta | |
| 5,079,978 | A | | 1/1992 | Kupfer | |
| 5,181,439 | A | | 1/1993 | Schwartz | |
| 5,461,944 | A | * | 10/1995 | Ciumaga | 76/119 |
| 5,498,158 | A | | 3/1996 | Wong | |
| 5,897,762 | A | | 4/1999 | Liu | |
| 5,992,626 | A | | 11/1999 | Anderson | |
| 6,047,618 | A | | 4/2000 | Pieri | |

* cited by examiner

*Primary Examiner*—Hwei-Siu Payer
(74) *Attorney, Agent, or Firm*—Birch, Stewart, Kolasch & Birch, LLP

(57) ABSTRACT

A set of driver bits for Robertson screw fasteners includes driver bits (10*a–d*) whose shaft bodies (12*a–d*) have distinctive markings thereon corresponding to respective sizes of working tips (14*a–d*) of the driver bits. These distinctive markings are consistent throughout a family of sets. In one embodiment the distinctive marking are different colors, with each different color corresponding to a working-tip size. The colors are applied only to shaft bodies (36*a–d*) of some of the driver bits by plating the shaft bodies with zinc layers (22) and then dying the outer surfaces of the zinc layers with color dye (24). This coloring is carried out before the shaft bodies are connected to their respective working tips. Once the outer surfaces (20) of the shaft bodies are thusly colored, the respective working tips are swaged to the shaft bodies to thereby form color-coded Robertson driver bits. In another embodiment, the distinctive markings are surface-irregularity rings (32) extending about the elongated shafts, with the least number of rings corresponding to the smallest size working tip and the most number rings corresponding to the largest working tip.

5 Claims, 3 Drawing Sheets

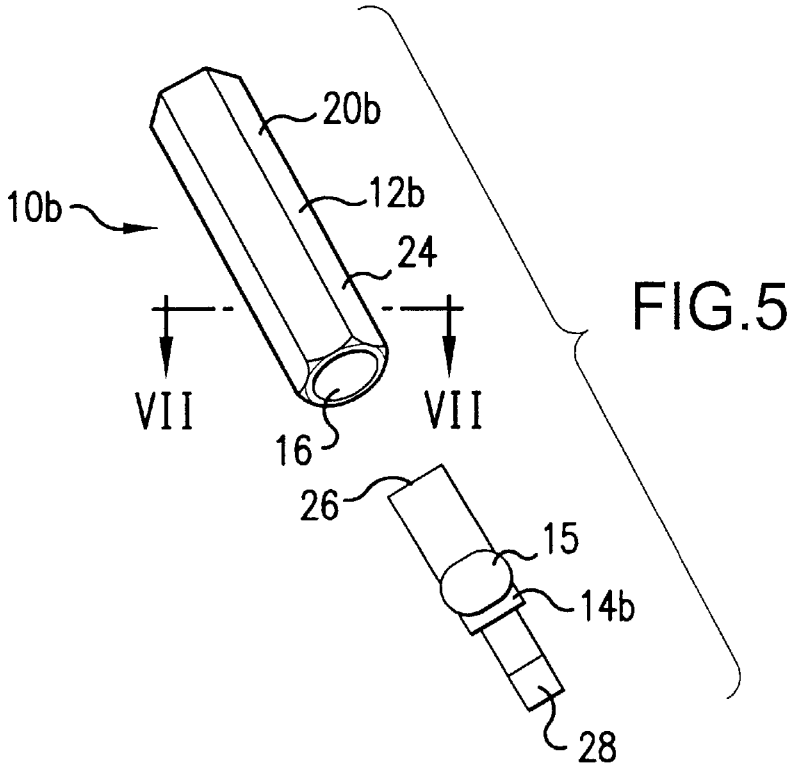
FIG.5
FIG.6
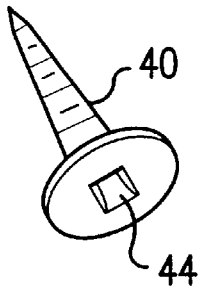
FIG.7
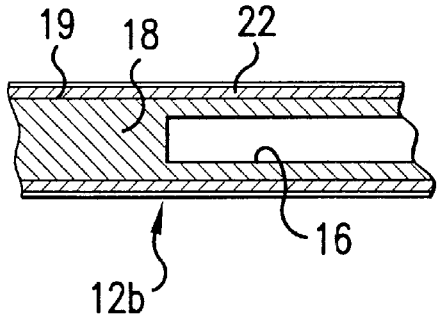

PROCESS OF MAKING A SET OF DISTINGUISHABLE ROBERTSON DRIVER BITS

This application is a divisional of application Ser. No 09/393,626, filed on Sep. 10, 1999, now abandoned, the entire contents of which are hereby incorporated by reference and for which priority is claimed under 35 U.S.C. §121.

BACKGROUND OF THE INVENTION

This invention relates generally to fastener driver bits and more particularly to a system for distinctively marking driver bits of a set and of a family of sets of driver bits, and to a process for coloring driver bits so that different size driver bits can be easily recognized.

Robertson fasteners (screws, bolts, and the like) have been used since around 1908. Such a fastener has a head similar to heads of standard-groove screws and Phillips-head screws, but with a square indentation for receiving an elongated square working tip of a Robertson driver. There are, for example, Robertson screwdrivers, each having a handle, a shaft, and a square working tip for engaging the square indentations of Robertson screws. Generally, there are four sizes of Robertson working tips, often designated as 0, 1, 2 and 3 size working tips, with size 0 being the smallest and size 3 being the largest. These different size working tips are typically used to drive different size screws as follows:

| ROBERTSON WORKING TIP SIZE | FOR SCREW SIZES |
|---|---|
| 0 | 4 and less |
| 1 | 5–7 |
| 2 | 8–10 |
| 3 | 12–14 |

The larger screws have larger Robertson square indentations and the working tip sizes for driving the larger screws are correspondingly also larger.

Robertson driver bits are also available for driving Robertson fasteners with power driving machines, such as electric drills. A problem is that it is difficult to distinguish different working-tip sizes of driver bits when an entire set of driver bits is in a tool chest. Thus, one using the driver bits must expend an inordinate amount of time choosing a Robertson driver bit with a desired working-tip size.

It is therefore an object of this invention to provide a set of, and a family of sets of, Robertson driver bits which allow a user to easily distinguish the working-tip sizes of the individual driver bits. Similarly, it is an object of this invention to provide a method of marking Robertson driver bits so that their sizes can be easily recognized.

Robertson screwdrivers are sometimes sold in sets and sometimes plastic handles of the individual screwdrivers of the sets have different colors, with the 0 working-tip size being designated by a yellow plastic handle, the 1 working-tip size being designated by a green handle, the 2 working-tip size being designated by red, and the 3 working-tip size being designated by black. This system of color coding has been found to be useful for distinguishing the different working-tip sizes of Robertson screwdrivers. However, the problem of distinguishing Robertson driver bits has remained.

U.S. Pat. No. 4,559,936 to Hill, U.S. Pat. No. 5,498,158 to Wong, U.S. Pat. No. 4,982,627 to Johnson, and U.S. Pat. No. 5,897,762 to Liu all describe color-coded power cutting tools. However, none of these systems is related to driver bits, much less to Robertson driver bits, and some of them are overly complicated and difficult to use.

SUMMARY

According to principles of this invention, a set of driver bits for Robertson screw fasteners includes driver bits whose shaft bodies have distinctive markings thereon corresponding to respective sizes of working tips of the driver bits. These distinctive markings are consistent throughout a family of such sets. In one embodiment, the distinctive markings are different colors, each color corresponding to a working-tip size. The colors are applied to entire outer surfaces of shaft bodies of some of the driver bits by plating the shaft bodies with zinc layers and then dying the zinc layers with color dyes. Some of the driver bits are colored by applying a colored zinc coat or black oxide. This coloring is carried out before the shaft bodies are connected to their respective working tips. Once the outer surfaces of the shaft bodies are thusly colored, the respective elongated working tips are swaged to the shaft bodies to thereby form color-coded Robertson driver bits. In another embodiment, the distinctive markings are surface-irregularity rings extending about the elongated shafts, with the least number of rings corresponding to the smallest size working tip and the most rings corresponding to the largest size working tip.

BRIEF DESCRIPTION OF THE DRAWING

The invention is described and explained in more detail below using embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the drawings in which reference characters refer to the same parts throughout the different views. The drawings are not necessarily to scale, emphasis instead being placed upon illustrating principles of the invention in a clear manner.

Each of FIGS. 1 through 4 is an isometric view of a Robertson driver bit of a color-coded embodiment of this invention, with the driver bits of all of these views taken together forming a set of color-coded Robertson driver bits of this invention;

FIG. 5 is an exploded isometric view of the Robertson driver bit of FIG. 2, as it appears during a phase of its fabrication;

FIG. 6 is an isometric view of a Robertson screw to be driven with a Robertson driver bit of this invention;

FIG. 7 is a segmented cross-sectional view taken on line VII—VII in FIG. 5; and Each of FIGS. 8 through 11 is an isometric view of a Robertson driver bit of a surface-irregularity embodiment of this invention, with the driver bits of all of these views taken together forming a set of Robertson driver bits of this invention;

DESCRIPTION OF THE PREFERRED EMBODIMENT

Figure 1:
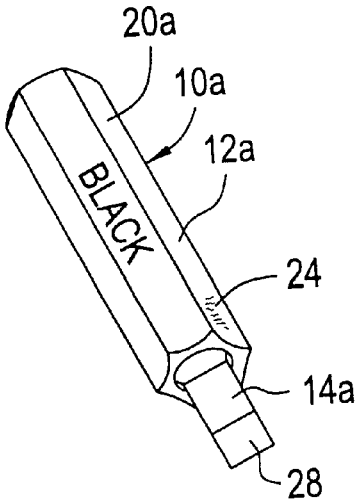

A set of driver bits 10*a–d* for Robertson screw fasteners is depicted in FIGS. 1–4, all of the driver bits of these drawings taken together forming the set. Each of the driver bits respectively comprises an elongated shaft-body 12*a–d* and an elongated working tip 14*a–d*. FIG. 5 depicts the driver bit 10*b* during a phase of its fabrication in which its working tip 14*b*, with a swage swell 15 thereon, is about to be inserted into a blind bore 16 in its shaft-body 12*b*. FIG. 7 shows a cross-sectional view of the shaft-body 12*b* in which one can see the blind bore 16.

The manner in which each of the driver bits 10*a–d* is constructed will now be described, first with reference to driver bit 10*b*, it being understood that each of the driver bits is constructed in basically the same manner, with some differences in applying colors, which differences are specifically pointed out below.

A blank 18 of the shaft-body 12*b* is first forged of mild steel and the working tip 14*b* is forged of hardened steel. The blank 18 of the shaft-body 12*b* has basically the shape of the shaft-body 12*b* shown in FIGS. 2 and 5, with a hexagonal blank outer surface 19 (in cross-section) and the blind bore 16. The blank outer surface 19 of the thusly forged blank 18 is then electroplated with a thin zinc layer 22. This entire zinc layer 22 is then dyed a red color using a red iridite dye 24. It has been found that the zinc layer 22 accepts the red iridite dye much more readily and permanently than does a steel surface.

Figure 2:
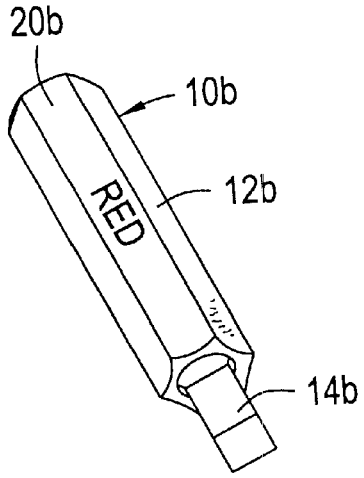
Figure 3:
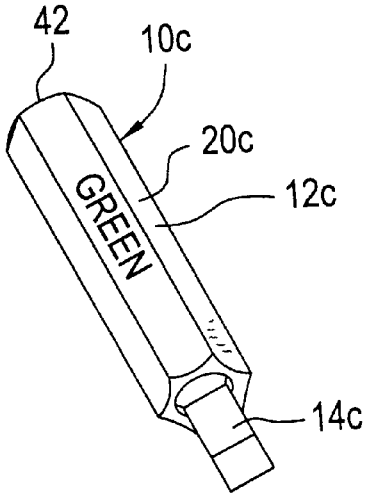
Figure 4:
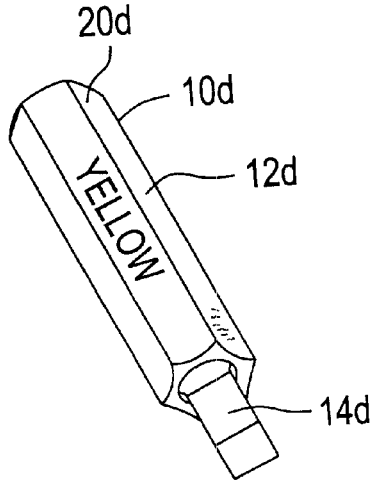
Figure 8:
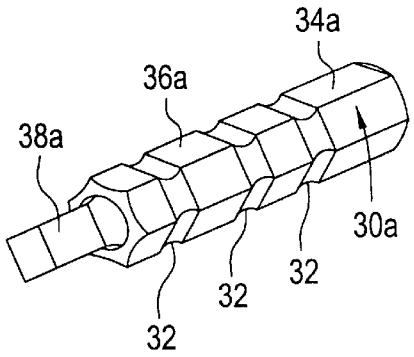
Figure 9:
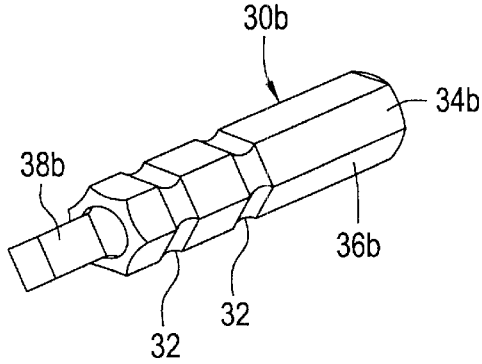
Figure 10:
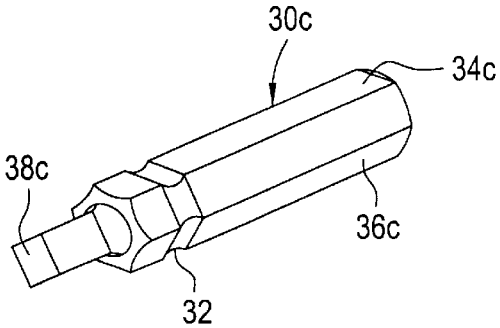
Figure 11:
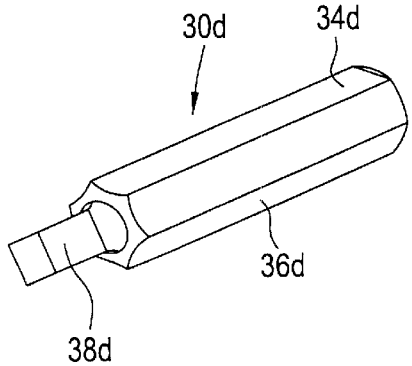

A rear end 26 of the working tip 14*b* is then inserted into the blind bore 16, with the working tip 14*b* being swaged to the shaft-body 12*b* and a working end 28 of the working tip 14*b* being left extending out of the end of the shaft-body 12*b*, as is shown in FIG. 2.

As mentioned above, each of the driver bits 10*a–d* can be constructed in substantially the same manner, but dyes, and processes used for coloring outer surfaces 20*a–d* of the shaft bodies 12*a–d* are different for different colors, with these colors corresponding to working-tip sizes (and screw sizes) of the driver bits as follows:

| Working tip size | SCREW SIZES | COLOR |
|---|---|---|
| 0 | 4 and less | yellow |
| 1 | 5–7 | green |
| 2 | 8–10 | red |
| 3 | 12–14 | black |

It should be noted that the correspondence of working-tip sizes to colors is the same as has been previously used by some manufacturers for plastic handles of Robertson screwdrivers. It should be further noted that the outer surfaces 20*a–d* of the thusly constructed shaft bodies 12*a–d* have substantially the same cross-sectional size and shape.

With further regard to dying, or coloring, it has been found to be convenient to color the red and green shaft bodies 12*b* and 12*c* in the manner set forth above, however, in a preferred embodiment the black shaft-body 12*a* is colored by placing a black oxide directly on the outer surface 19 of the steel blank 18 and the yellow shaft-body 12*d* is colored by placing a yellow zinc dichromate directly on the outer surface 19 of the steel blank 18. In another embodiment, a black zinc is placed directly on the steel blank to color the black shaft-body 12*a*.

FIGS. 8–11 depict a second-embodiment set of driver bits 30*a–d* are constructed for Robertson screw fasteners, with all of the driver bits of these drawings taken together forming a set. The driver bits 30*a–d* are constructed in the same manner as are the driver bits 10*a–d*, with the exception that instead of applying a zinc layer 22 and dye, or other colorings, ring indentations 32 are made in outer surfaces 34*a–d* of shaft bodies 36*a–d* thereof. As can be seen in FIGS. 8–11 the driver bit 30*d*, with the smallest working tip 38*d*, has no rings, the driver bit 30*c* with the next larger working tip 38*c*, has one ring, the next larger working tip 38*b* is designated by two rings, and the next working tip 38*a* by three rings. It is also preferred in this embodiment that each of the shaft bodies 36*a–d* and the working tips 38*a–d* be forged separately and then swaged together after markings are applied, as in the embodiments of the FIGS. 1–4.

In use, the driver bits 10*a–d* and 30*a–d*, constructed as described above, are placed in a tool storage container and used as desired. If, for example, a user wishes to drive a #6 Robertson screw 40, he would know to choose the driver bit 10*c* with the green colored shaft-body 12*c*. That is, the colors make it much easier for a user to distinguish between the different size driver bits 10*a–d*. Once the user has chosen the desired driver bit 12*c*, he inserts a chuck-engaging end 42 thereof into a chuck of a driving-machine, such as an electric drill, and tightens the chuck on the shaft-body 12*c*. The user then manipulates the driving-machine to insert the working tip 14*c* into a square indentation 44 of the #6 Robertson screw 40, and then activates the driving machine to rotate the Robertson screw and drive it into work material.

It should be understood by those skilled in the art that the ring indentations 32 of the FIGS. 8–11 embodiment also make it easier for a user to distinguish between the different size driver bits 30*a–d*, and are used in the same manner as is color for distinguishing between the different size driver bits 30*a–d*, and is perhaps even more intuitive in use. These driver bits are particularly helpful for people who are visually impaired. Otherwise, the description in the proceeding paragraph also applies to the FIGS. 8–11 embodiment.

It should also be understood by those of ordinary skill in the art that a set of driver bits of this invention makes it easier and faster for a user to pick out a correct size driver bit to be used.

Further, this invention provides a method of marking Robertson driver bits which is uncomplicated to carry out and which provides driver bits which are easy and intuitive to recognize. Similarly, it provides distinctive markings for driver bits which can be seen from all angles and which are relatively large in size so that a user need not carefully examine the driver bits to find the markings.

The process of zinc coating and dying the shaft bodies before they are assembled with the working tips is relatively easy to carry out and makes it easy to see markings.

While the invention has been particularly shown and described with reference to a preferred embodiment, it will be understood by those skilled in the art that various changes in form and detail may be made therein without departing from the spirit and scope of the invention. For example, the same systems of marking can be used for driver bits that are constructed as one piece; that is with the respective shaft bodies and the working tips being forged from one piece of steel as one part. Also, the shaft bodies can also be colored, or plated, in other ways than those specifically described above. In this regard, technical improvements, production volume changes that make certain processes economically practical, and other factors can impact on the coloring process used.

The invention claimed is:

1. A process for making a set of driver bits for Robertson's fasteners, said set comprising a plurality of driver bits, each driver bit comprising:

an elongated shaft-body having a hexagonal shaft outer-surface cross-sectional shape, said shaft-body having a working-tip end and a chuck-engaging end, said shaft outer-surface cross-sectional shape and size being appropriate for fitting a chuck of a driving machine when the chuck-engaging end of the shaft-body is inserted into the chuck of the driving machine;

an elongated working tip having a square working-tip outer-surface cross-sectional shape, a rear end attached to the working-tip end of said elongated shaft-body with a free working end extending outwardly away from the working-tip end of the elongated shaft-body for being inserted into a square indentation of a Robertson screw fastener, with the free working end of each of the driver bits of the set having a different working-tip outer-surface cross-sectional size than each of the other working tips of the set of driver bits;

wherein the shaft outer surface of the shaft-body of each of the driver bits of the set has a distinctive color marking thereon corresponding to the working-tip outer-surface cross-sectional size, with the distinctive marking for each driver bit being different than the distinctive color markings of all of the other driver bits of the set for helping a user select a driver bit from the set with a particular size working tip comprising the steps of:

providing separate shaft-body blanks and separate working tips, one each for each driver bit of the set;

while the shaft-body blanks are not attached to the working tips, applying coloring to each of the shaft-body blanks to create the shaft bodies, with each shaft-body having a different color dye applied thereto; and thereafter attaching the shaft-body blanks and the working tips together;

wherein:

the step of applying coloring comprises the substeps of applying a zinc layer on an outer surface of a first of the shaft-body blanks, and applying a dye to the zinc layer for coloring the zinc layer;

the step of applying coloring comprises the substep of placing a black oxide directly on an outer surface of a second of the shaft-body blanks; and the step of applying coloring comprises the substep of placing a yellow zinc dichromate directly on an outer surface of a third of the shaft-body blanks.

2. A process for making a set of driver bits for Robertson's fasteners, said set comprising a plurality of driver bits, each driver bit comprising:

an elongated shaft-body having a hexagonal shaft outer-surface cross-sectional shape, said shaft-body having a working-tip end and a chuck-engaging end, said shaft outer-surface cross-sectional shape and size being appropriate for fitting a chuck of a driving machine when the chuck-engaging end of the shaft-body is inserted into the chuck of the driving machine;

an elongated working tip having a square working-tip outer-surface cross-sectional shape, a rear end attached to the working-tip end of said elongated shaft-body with a free working end extending outwardly away from the working-tip end of the elongated shaft-body for being inserted into a square indentation of a Robertson screw fastener, with the free working end of each of the driver bits of the set having a different working-tip outer-surface cross-sectional size than each of the other working tips of the set of driver bits;

wherein the shaft outer surface of the shaft-body of each of the driver bits of the set has a distinctive color marking thereon corresponding to the working-tip outer-surface cross-sectional size, with the distinctive marking for each driver bit being different than the distinctive color markings of all of the other driver bits of the set for helping a user select a driver bit from the set with a particular size working tip comprising the steps of:

providing separate shaft-body blanks and separate working tips, one each for each driver bit of the set;

while the shaft-body blanks are not attached to the working tips, applying coloring to each of the shaft-body blanks to create the shaft bodies, with each shaft-body having a different color dye applied thereto; and thereafter attaching the shaft-body blanks and the working tips together;

wherein the step of applying coloring to the shaft-body blanks comprises the substep of placing a yellow zinc dichromate directly on an outer surface of at least one of the shaft-body blanks.

3. A process for making a set of driver bits for Robertson's fasteners, said set comprising a plurality of driver bits, each driver bit comprising:

an elongated shaft-body having a hexagonal shaft outer-surface cross-sectional shape, said shaft-body having a working-tip end and a chuck-engaging end, said shaft outer-surface cross-sectional shape and size being appropriate for fitting a chuck of a driving machine when the chuck-engaging end of the shaft-body is inserted into the chuck of the driving machine;

an elongated working tip having a square working-tip outer-surface cross-sectional shape, a rear end attached to the working-tip end of said elongated shaft-body with a free working end extending outwardly away from the working-tip end of the elongated shaft-body for being inserted into a square indentation of a Robertson screw fastener, with the free working end of each of the driver bits of the set having a different working-tip outer-surface cross-sectional size than each of the other working tips of the set of driver bits;

wherein the shaft outer surface of the shaft-body of each of the driver bits of the set has a distinctive color marking thereon corresponding to the working-tip outer-surface cross-sectional size, with the distinctive marking for each driver bit being different than the distinctive color markings of all of the other driver bits of the set for helping a user select a driver bit from the set with a particular size working tip comprising the steps of:

providing separate shaft-body blanks and separate working tips, one each for each driver bit of the set;

while the shaft-body blanks are not attached to the working tips, applying coloring to each of the shaft-body blanks to create the shaft bodies, with each shaft-body having a different color dye applied thereto; and thereafter attaching the shaft-body blanks and the working tips together;

wherein the step of applying coloring to the shaft-body blanks comprises the substep of placing a black oxide directly on an outer surface of at least one of the shaft-body blanks.

4. A process for making a set of driver bits for Robertson's fasteners, said set comprising a plurality of driver bits, each driver bit comprising:

an elongated shaft-body having a hexagonal shaft outer-surface cross-sectional shape, said shaft-body having a working-tip end and a chuck-engaging end, said shaft outer-surface cross-sectional shape and size being appropriate for fitting a chuck of a driving machine when the chuck-engaging end of the shaft-body is inserted into the chuck of the driving machine;

an elongated working-tip having a square working-tip outer-surface cross-sectional shape, a rear end attached to the working-tip of said elongated shaft-body with a free working end extending outwardly away from the working-tip end of the elongated shaft-body for being inserted into a square indentation of a Robertson screw fastener, with the free working end of each of the driver bits of the set having a different working-tip outer-surface cross-sectional size than each of the other working tips of the set of driver bits;

wherein the shaft outer surface of the shaft-body of each of the driver bits of the set has a distinctive color marking thereon corresponding to the working-tip outer-surface cross-sectional size, with the distinctive marking for each driver bit being different than the distinctive color markings of all of the other driver bits of the set for helping a user select a driver bit from the set working tip comprising the steps of:

providing separate shaft-body blanks and separate working tips, one each for each driver bit of the set;

while the shaft-body blanks are not attached to the working tips, applying coloring to each of the shaft-body blanks to create the shaft bodies, with each shaft-body having a different color dye applied thereto; and thereafter attaching the shaft-body blanks and the working tips together;

wherein the step of applying coloring comprises the substeps of applying a zinc layer on an outer surface of at least one of the shaft-body blanks and applying dye to the zinc layer for coloring the zinc layer.

5. The process of claim 1 wherein the zinc layer is applied to substantially an entire outer surface of each of the shaft-body blanks and substantially the entire zinc layer is then colored by applying dye thereto.

* * * * *